US006644368B1

(12) United States Patent
Chiang

(10) Patent No.: US 6,644,368 B1
(45) Date of Patent: Nov. 11, 2003

(54) WOOD PLANING MACHINE WITH AN ADJUSTING UNIT FOR ADJUSTING A HORIZONTAL POSITION OF A CUTTER CARRIAGE

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 10/191,106

(22) Filed: Jul. 9, 2002

(30) Foreign Application Priority Data

May 9, 2002 (TW) ..... 91206591 U

(51) Int. Cl.[7] ..... B27C 1/00
(52) U.S. Cl. ..... 144/130; 144/117.1
(58) Field of Search ..... 144/130, 129, 144/117.1, 114.1; 409/338, 204, 206, 212

(56) References Cited

U.S. PATENT DOCUMENTS 6,085,812 A * 7/2000 Chiang ..... 144/117.1
6,089,286 A * 7/2000 Liao ..... 144/117.1
6,123,125 A * 9/2000 Liao ..... 144/130
6,279,628 B1 * 8/2001 Chang ..... 144/130
6,283,181 B1 * 9/2001 Chiang ..... 144/130
6,289,950 B1 * 9/2001 Chiang ..... 144/117.1

* cited by examiner

*Primary Examiner*—Allen Ostrager
*Assistant Examiner*—Shelley Self
(74) *Attorney, Agent, or Firm*—Ladas & Parry

(57) ABSTRACT

A wood planing machine includes left and right ends mounted on a base via left and right pairs of posts. The ends are respectively formed with through holes to permit extension of left and right screw rods. Left and right thread members are respectively inserted in the through holes and engage the screw rods. A fine adjusting unit includes a mounting wall mounted on the left end, and a rod member having a first rod section mounted rotatably on the mounting wall, and a second rod section extending eccentrically from the first rod section and received fittingly in an engaging hole in the left thread member such that rotation of the first rod section results in vertical fine movement of the left thread member relative to the left screw rod.

2 Claims, 10 Drawing Sheets

WOOD PLANING MACHINE WITH AN ADJUSTING UNIT FOR ADJUSTING A HORIZONTAL POSITION OF A CUTTER CARRIAGE

CROSS REFERENCE TO RELATED APPLICATION

This application claims priority of Taiwan Application No.9126591, filed on May 9, 2002.

BACKGROUND OF THE INVENTION

1. Field of the Invention

The present invention relates to a wood planing machine, more particularly to a wood planing machine with an adjusting unit for adjusting a horizontal position of a cutter carriage of the wood planing machine.

2. Description of the Related Art

Referring to FIGS. 1 to 3, a conventional wood planing machine is shown to include a base 11 having left and right sides, left and right pairs of posts 12 extending uprightly from the left and right sides of the base 11, a cutter carriage 13 having left and right carriage ends 131 mounted slidably and respectively on the left and right pairs of posts 12, and left and right screw rods 16 mounted rotatably on the left and right sides of the base 11. Tubular left and right thread members 15 extend through two through holes in the left and right carriage ends 131. The left and right screw rods 16 extend through and threadedly engage the thread members 15, respectively. Left and right fastening nuts 19 threadedly and respectively engage the thread members 15 so as to secure the thread members 15 on the cutter carriage 13. A transmission unit 18 includes two sprockets 181 fixed to lower ends of the left and right screw rods 16, and a transmission chain 182 trained on the sprockets 181 so as permit synchronous rotation of the left and right screw rods 16, which, in turn, results in vertical movement of the cutter carriage 13 relative to the base 11. A handle 17 is mounted on a top end of the right screw rod 16 to facilitate turning of the left and right screw rods 16.

One disadvantage associated with the aforementioned conventional wood planing machine resides in that adjustment of the cutter carriage 13 to a horizontal position, in which the cutter carriage 13 is parallel to the base 11, is inconvenient.

SUMMARY OF THE INVENTION

Therefore, the object of this invention is to provide a wood planing machine with an adjusting unit that is easy to operate for adjusting the cutter carriage to the horizontal position so as to eliminate the aforesaid disadvantage.

Accordingly, a wood planing machine of the present invention includes a base, left and right pairs of posts, a cutter carriage, left and right screw rods, a transmission unit, left and right thread members, and an adjusting unit. The base has left and right sides. The left and right pairs of posts extend uprightly from the left and right sides of the base, respectively. The cutter carriage includes left and right carriage ends mounted respectively and slidably on the left and right pair of posts. The cutter carriage defines a horizontal line extending from the left carriage end to the right carriage end. Each of the left and right carriage ends is formed with a vertical through hole. Each of the left and right screw rods defines an axis, extends through a respective one of the through holes in the left and right carriage ends, and is rotatable about the axis. Each of the left and right screw rods has a plurality of teeth, an adjacent pair of which defines a pitch therebetween. The transmission unit connects the left and right screw rods to permit synchronous rotation of the left and right screw rods. The left and right thread members are provided on the left and right carriage ends, and threadedly engage the left and right screw rods, respectively, so as to permit vertical movement of the cutter carriage relative to the base along the posts upon rotation of the left and right screw rods. The left thread member is formed with an engaging hole extending in a transverse direction relative to the axis. The adjusting unit includes a mounting wall mounted on the left carriage end adjacent to the left thread member, and a rod -member that extends in the transverse direction and that has a first rod section mounted rotatably on the mounting wall and a second rod section extending eccentrically from the first rod section and received fittingly in the engaging hole in the left thread member. The fine adjusting unit is operable in case the horizontal line is not parallel to the base after adjustment of the cutter carriage to a desired level via rotation of the left and right screw rod such that rotation of the first rod section results in vertical movement of the left thread member relative to the left screw rod by a distance within the pitch, thereby permitting the horizontal line to be parallel to the base.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
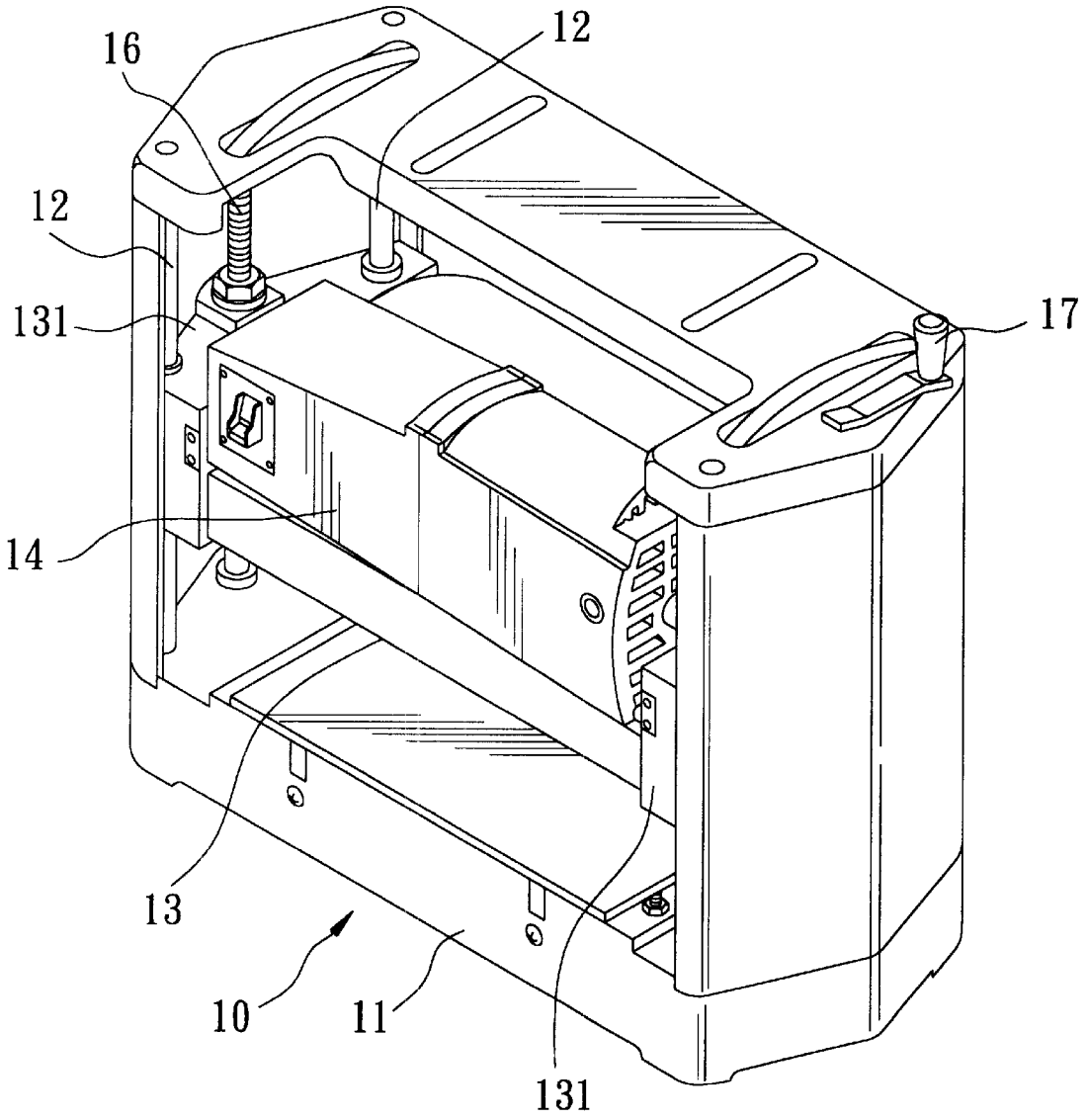
FIG. 1 PRIOR ART
FIG. 1 is a perspective view of a conventional wood planing machine.
Figure 2:
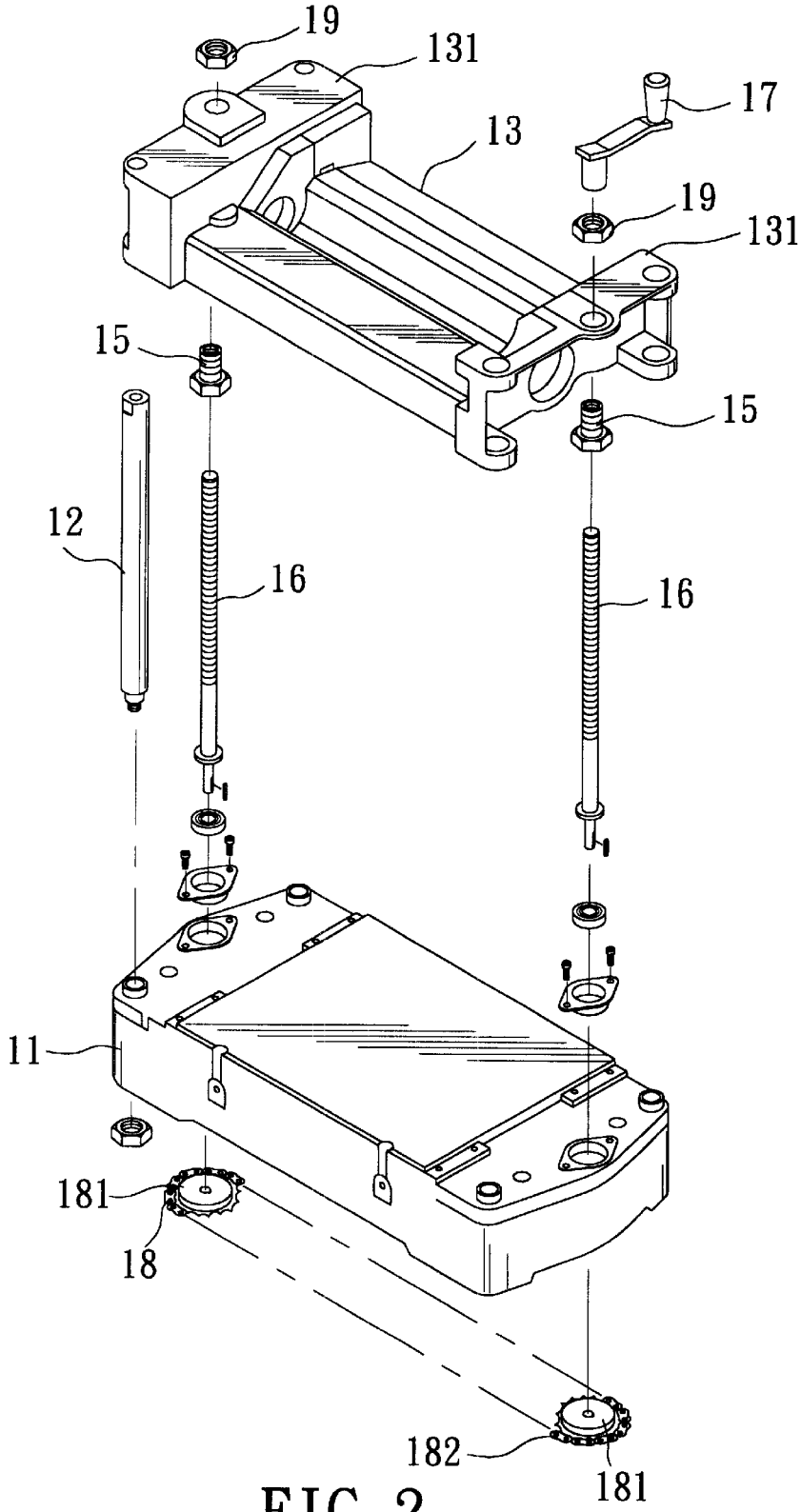
FIG. 2 PRIOR ART
FIG. 2 is an exploded view of the conventional wood planing machine.
Figure 3:
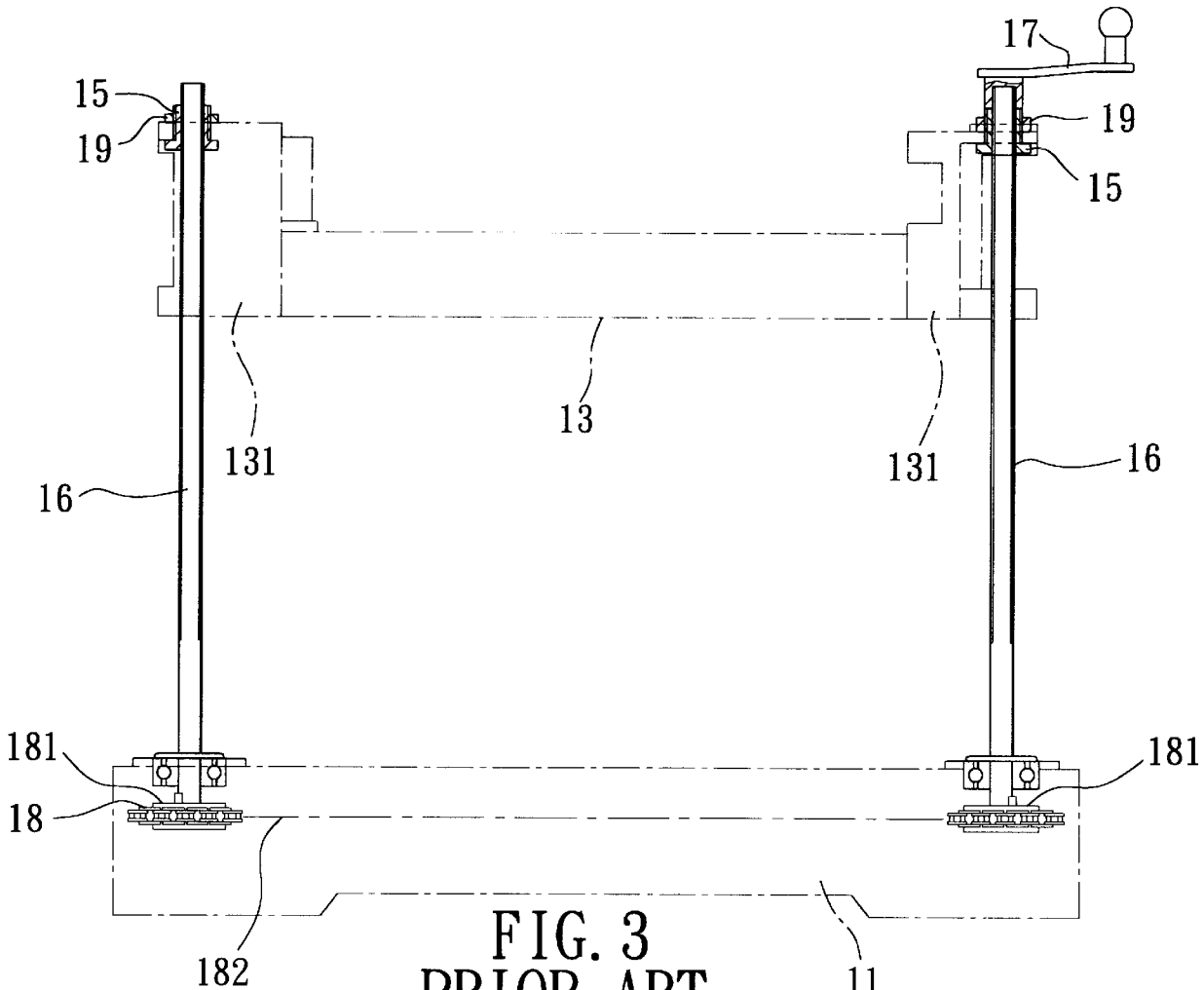
FIG. 3 PRIOR ART
FIG. 3 is a partly sectional view of the conventional wood planing machine.
Figure 4:
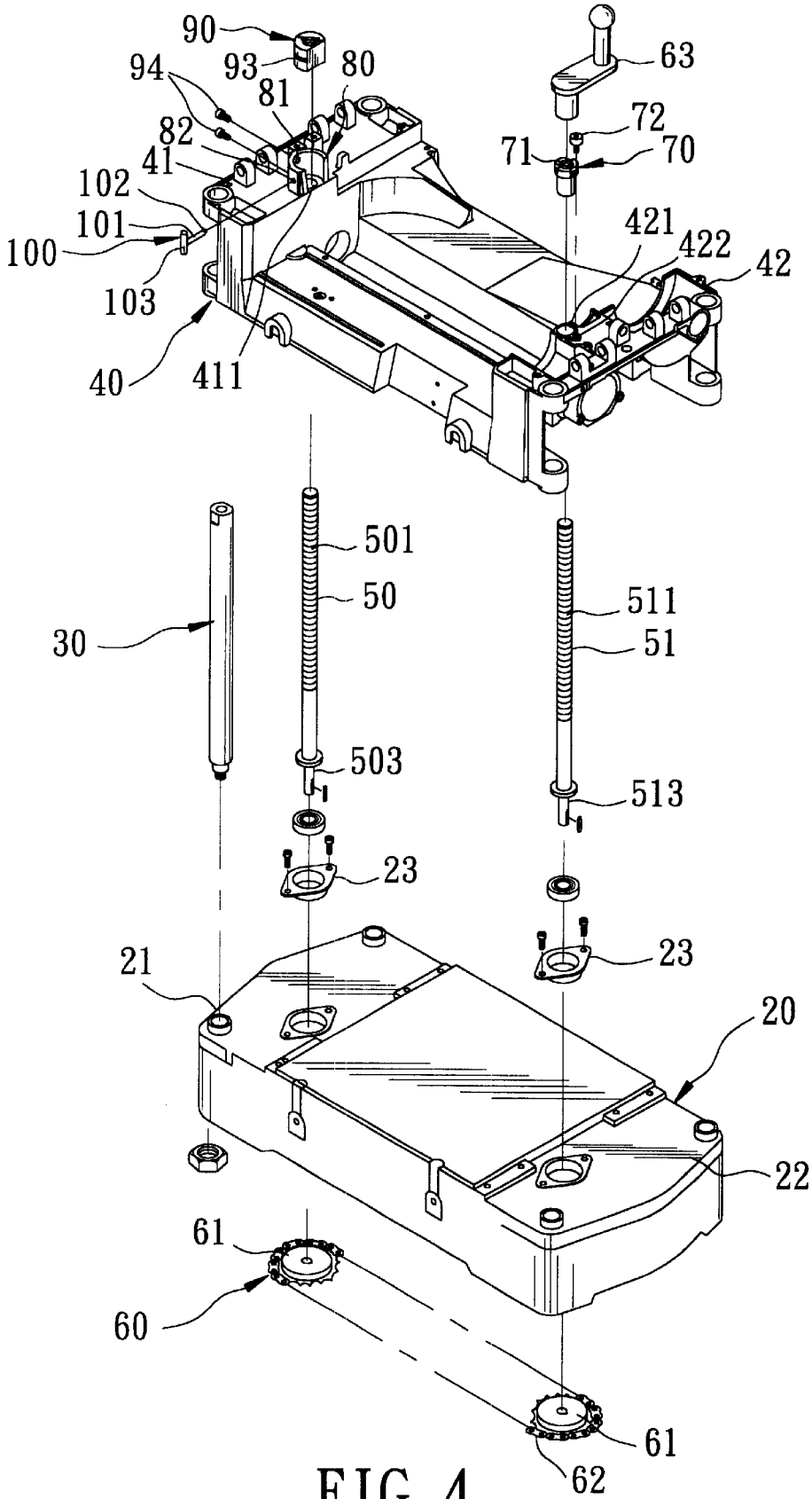
FIG. 4 is an exploded perspective view of a preferred embodiment of a wood planing machine according to the present invention.
Figure 5:
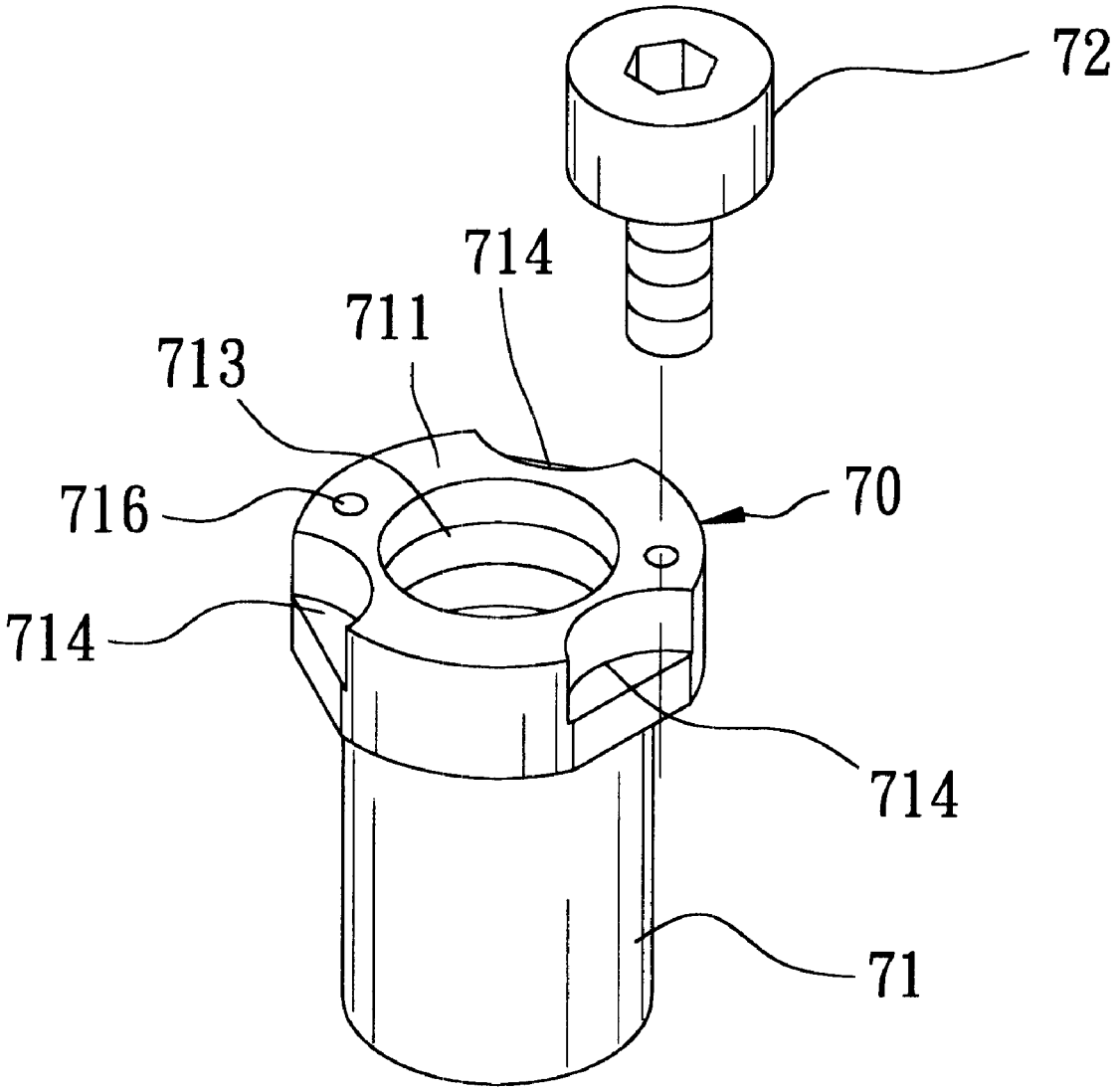
FIG. 5 is a perspective view of a right thread member employed in the preferred embodiment.

Referring to FIGS. 4 and 5, the preferred embodiment of a wood planing machine according to the present invention is shown to include a base 20, left and right pairs of posts 30 (only one is shown in FIG. 4), a cutter carriage 40, left and right screw rods 50, 51, a transmission unit 60, left and right thread members 90, 70, and a fine adjusting unit.

As illustrated, the base 20 has left and right sides 21, 22.

The left and right pairs of posts 30 extend uprightly and respectively from the left and right sides 21, 22 of the base 20.

The cutter carriage 40 includes left and right carriage ends 41, 42 mounted respectively and slidably on the left and right pair of posts 30. Each of the left and right carriage ends 41, 42 is formed with a vertical through hole 411, 421. The cutter carriage 40 defines a horizontal line (x) extending from the left carriage end 41 to the right carriage end 42.

The left and right screw rods 50, 51 are mounted uprightly on the left and right sides 21, 22 of the base 20, respectively, via left and right bearing ends 23, and have engaging portions 501, 511 disposed above the base 20, and bottom ends 503, 513 disposed underneath a bottom side of the base 20. Each of the left and right screw rods 50, 51 defines an axis, extends through a respective one of the through holes 411, 421 in the carriage ends 41, 42, and is rotatable about the axis. Preferably a handle 63 is mounted on a top end of the right screw rod 51 to facilitate turning of the right screw rod 51. The engaging portion 501, 511 of each of the left and right screw rods 50, 51 has a plurality of threads 502, 512, an adjacent pair of which defines a pith 120, 110 therebetween (see FIG. 10).

The transmission unit 60 includes two sprockets 61 and a transmission chain 62. The sprockets 61 are fixed to the bottom ends 503,513 of the left and right screw rods 50, 51, respectively. The transmission chain 62 is trained on the sprockets 61 to permit synchronous rotation of the left and right screw rods 50, 51.

The left and right thread members 90, 70 are respectively provided on the left and right carriage ends 41, 42, and threadedly engage the engaging portions 501, 511 of the left and right screw rods 50, 51, respectively, so as to permit vertical movement of the cutter carriage 40 relative to the base 20 along the posts 30 upon rotation of the left and right screw rods 50, 51. The left thread member 90 is formed with an engaging hole 93 extending in a transverse direction relative to the axes of the left and right screw rods 50, 51.

Figure 8:
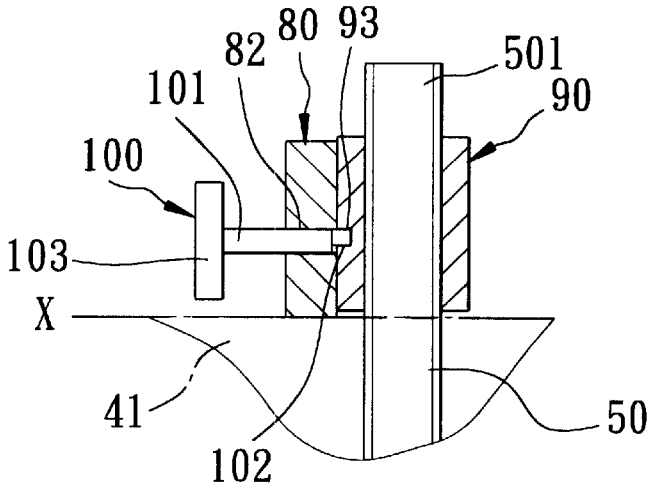
FIG. 8 is a fragmentary sectional view of the preferred embodiment after adjustment of the cutter carriage relative to the horizontal line.

The fine adjusting unit includes a mounting wall 80 and a rod member 100. The mounting wall 80 is mounted uprightly on the left carriage end 41 adjacent to the left thread member 90, and is formed with a mounting hole. The rod member 100 extends in the transverse direction, and has a first rod section 101 mounted rotatably in the mounting hole in the mounting wall 80, and a second rod section 102 that extends eccentrically from the first rod section 101 and that is received fittingly in the engaging hole 93 in the left thread member 90. The fine adjusting unit is operable in case the horizontal line (X) of the cutter carriage 40 is not parallel to the base 20 after adjustment of the cutter carriage 40 to a desired lever via rotation of the left and right screw rods 50, 51 such that rotation of the first rod section 101 on the mounting wall 80 (see FIG. 8) results in vertical movement of the left thread member 90 relative to the left screw rod 50 by a distance within the pitch 120, thereby permitting the horizontal line (X) to be parallel to the base 20. To prevent disengagement and wobbling of the left thread member 90 relative to the left carriage end 41, two fastener screws 94 extend through two through holes 81 in the mounting wall 80 and engage two threaded holes 92 in the left threaded member 90 (see FIG. 9).

Figure 9:
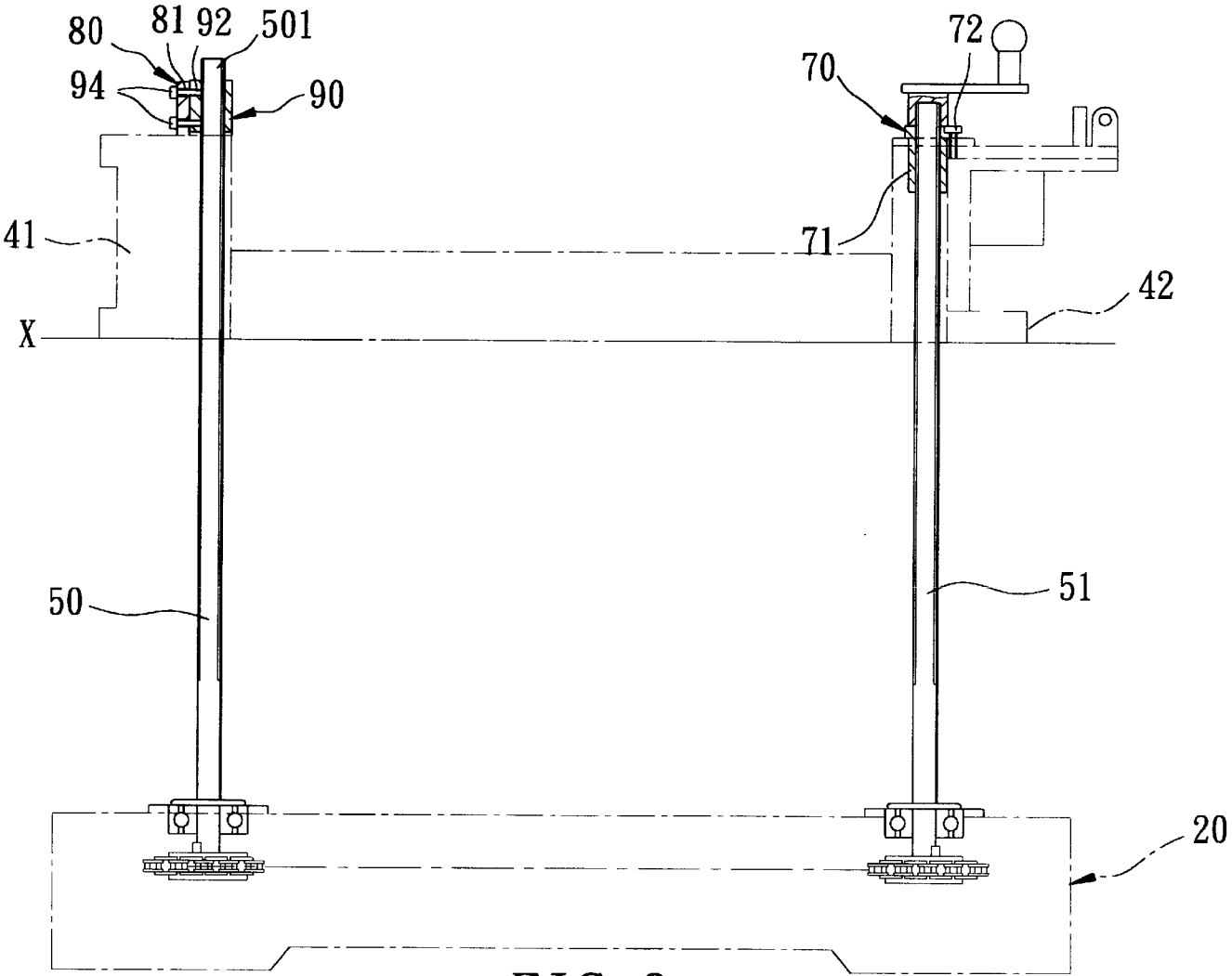
FIG. 9 a side view of the preferred embodiment, illustrating a state of the cutter carriage after adjustment of the same relative to the horizontal line.
Figure 10:
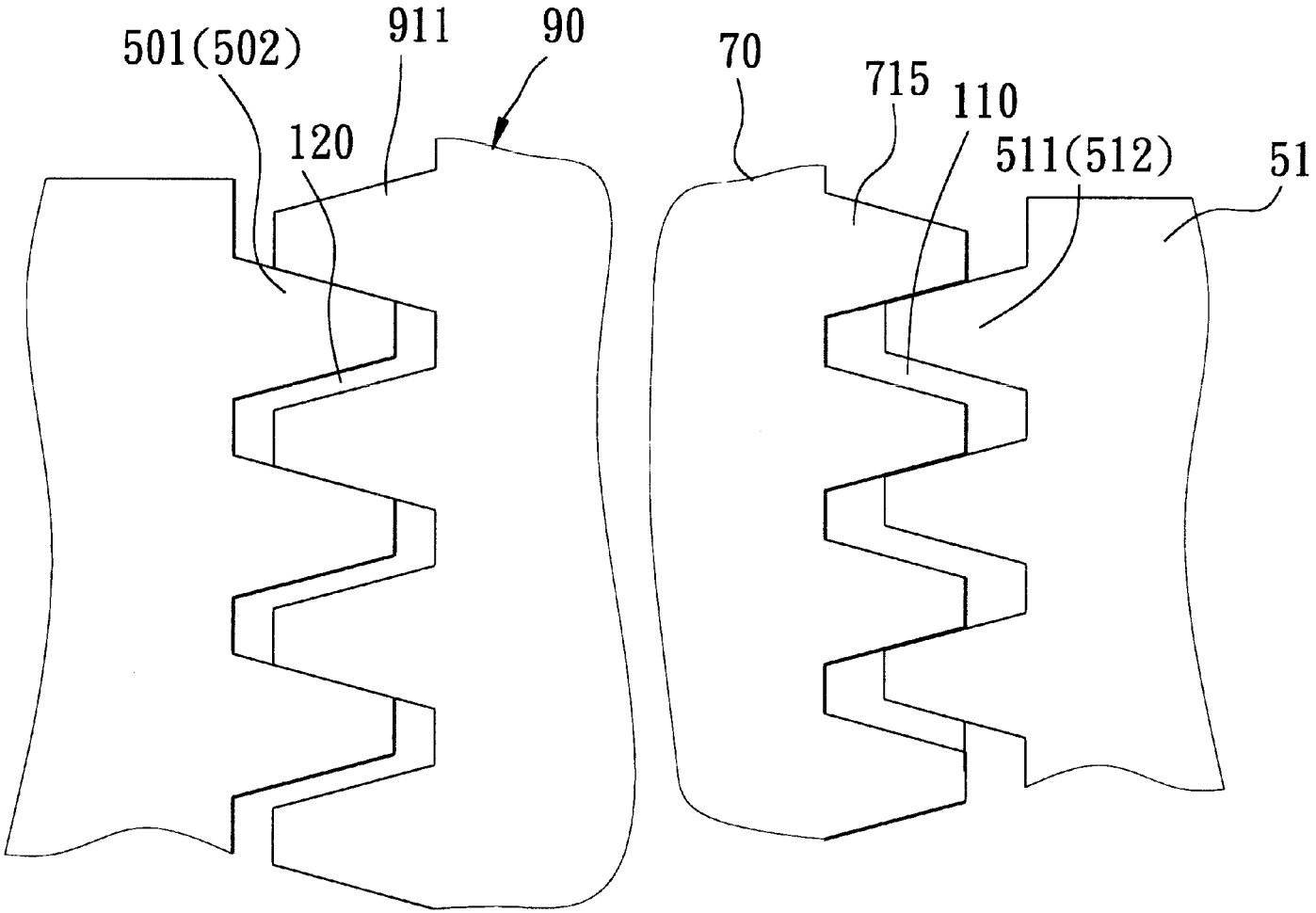
FIG. 10 illustrates a relationship between a left thread member and a left screw rod when the cutter carriage of the preferred embodiment is inclined relative to the horizontal line as shown in FIG. 6.

Referring to FIG. 9, when the cutter carriage 40 of the preferred embodiment is at the horizontal position, the cutter carriage 40 is parallel to the base 20 (i.e., the cutter carriage 40 extends along a horizontal line X). At this position, engaging portions 911, 715 of the left and right thread members 90, 70 rest on the engaging portions 501, 511 of the left and right screw rods 50, 51 due to weight of the cutter carriage 40. Thus, the pitch 120 defined between an adjacent pair of the threads 502 of the left screw rod 50 is disposed below the corresponding pair of the threads (502, 911) of the left screw rod 51 and the left thread member 90, and the pitch 110 defined between an adjacent pair of the threads 512 of the right screw rod 51 is disposed below the corresponding pair of the threads (715, 512) of the right thread member 70 and the right screw rod 51, as best shown in FIG. 10.

Figure 6:
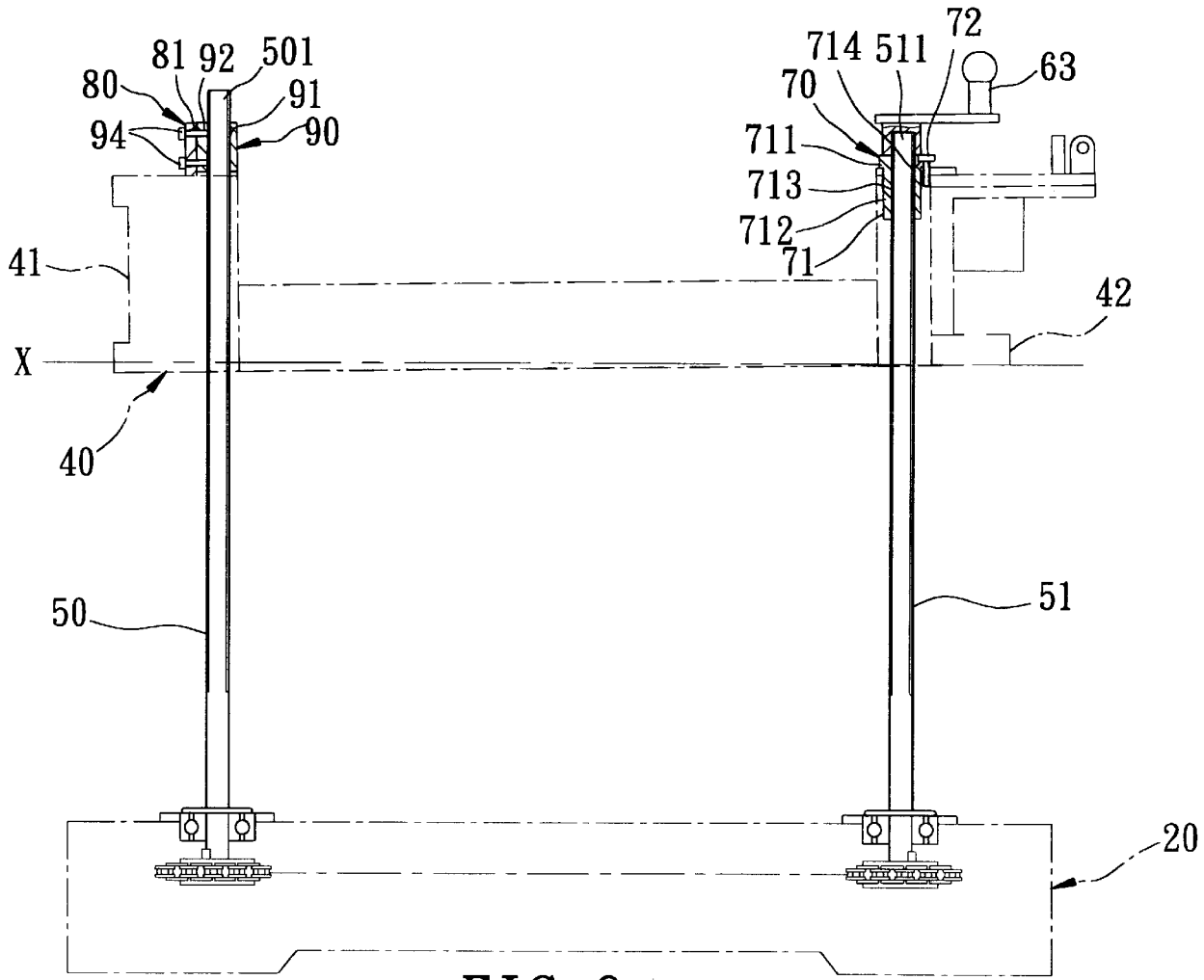
FIG. 6 is a side view of the preferred embodiment, illustrating how a left side of a cutter carriage is inclined relative to a horizontal line.
Figure 7:
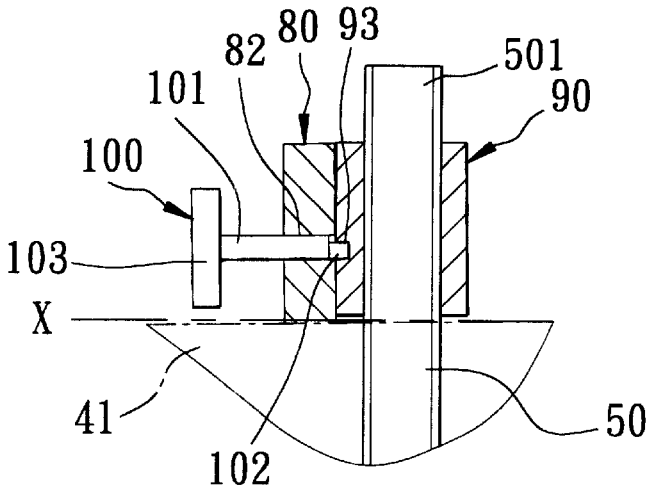
FIG. 7 is a fragmentary sectional view of the preferred embodiment prior to an adjustment of the cutter carriage relative to the horizontal line.
Figure 11:
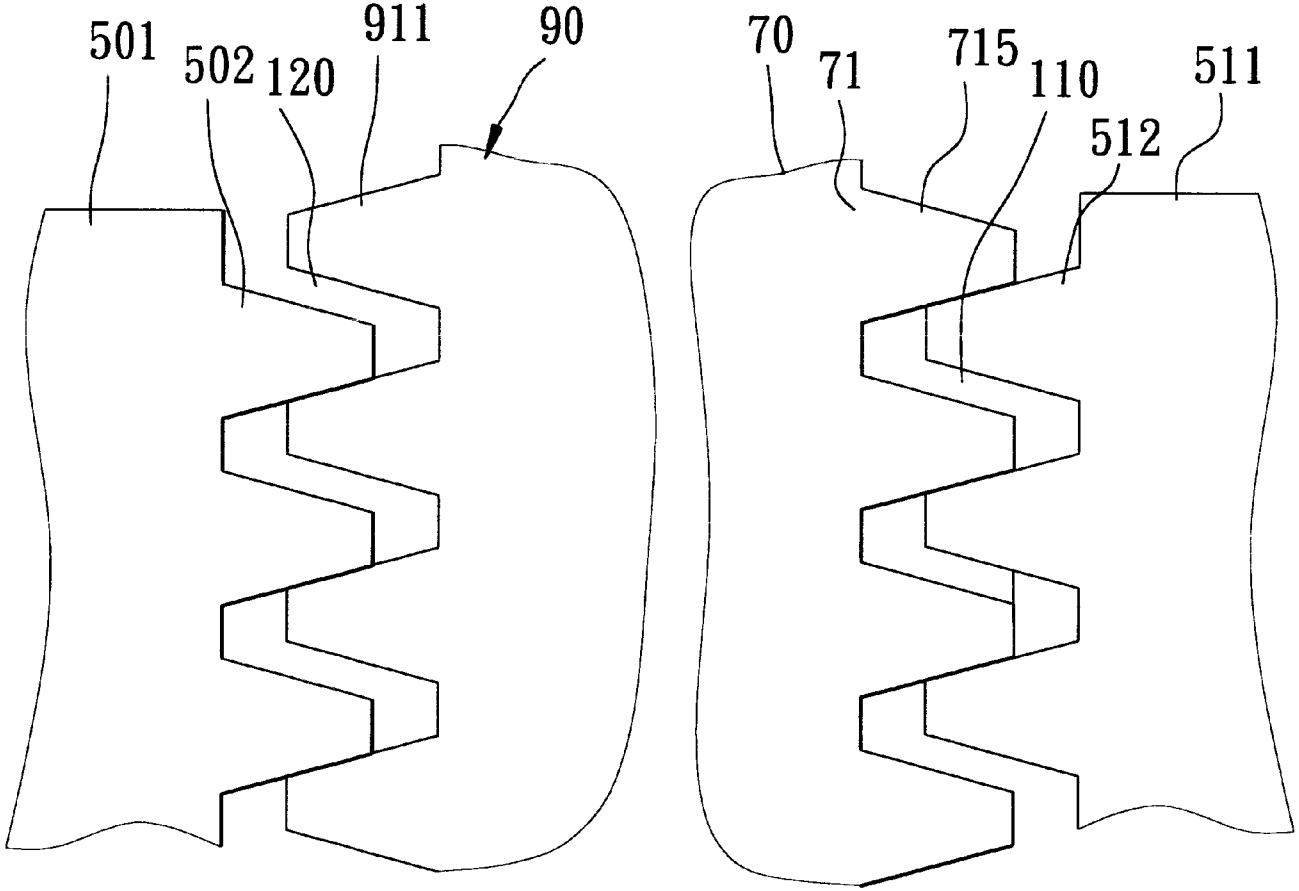
FIG. 11 illustrates a relationship between the left thread member and the left screw rod of the preferred embodiment, in which, the left thread member is lifted upward after adjustment of the cutter carriage relative to the horizontal line as shown in FIG. 9.

Referring to FIG. 6, when the cutter carriage 40 of the wood planing machine according to the present invention inclines relative to the horizontal line (X) after adjustment of the cutter carriage 40 to a desired level via rotation of the left and right screw rods 50, 51, the pith 120 between adjacent pair of the threads 502 in the left screw rod 50 will change its position relative to the left thread member 90. Under this condition, the position of the cutter carriage 40 should be adjusted so as to dispose the same to extend in the horizontal line (X) .For fine adjustment, the fastener screws 94 mounted on the mounting wall 80 for securing the left thread member 90 relative to the left screw rod 51 are slightly loosened. The rod member 100 is turned relative to the mounting wall 80, which, in turn, results in eccentric rotation of the second rod section 102 in the engaging hole 93, thereby vertically raising the left thread member 90 by the distance within the pitch 120 relative to the left screw rod 51, as best shown in FIG. 11, thereby changing the position of the pitch 120 different from that shown in FIG. 10, in which, the pitch 120 is disposed above the corresponding pair of the threads (911, 502) of the left thread member 90 and the left screw rod 50, thereby permitting the horizontal line (X) to be parallel to the base 20.

In this embodiment, the right carriage end 42 is further formed with a threaded hole 422 adjacent to the through hole 421, and includes a headed pressing screw 72 that threadedly engages the threaded hole 422 and that has a head portion. Referring to FIG. 5, the right thread member 70 includes a tubular portion 71 fittingly inserted into the through hole 421, and has inner threads 713 engaging the engaging portion 511 of the right screw rod 51, and a ending flange 711 that extends radially and outwardly from a top end of the tubular portion 71, that is ended on the right carriage end 42 around the periphery of the through hole 421, and that is formed with three angularly spaced apart shoulders 714. The head portion of the headed pressing screw 72 selectively engages and presses one of the shoulders 714 so as to prevent disengagement and wobbling of the right thread member 70 relative to the right screw rod 51. Preferably, the ending flange 711 is formed with two tool-holes 716 to facilitate turning of the right thread member 70 relative to the right screw rod 51 by means of a tool (not shown) . Adjustment of the right thread member 70 to selectively align one of the shoulders 714 with the threaded hole 422 permits vertical fine adjustment of the right carriage end 42 relative to the right screw rod 51.

With this invention thus explained, it is apparent that numerous modifications and variations can be made without departing from the scope and spirit of this invention. It is therefore intended that the invention be limited only as indicated in the appended claims.

I claim:

1. A wood planing machine comprising:

a base having left and right sides;

left and right pairs of posts extending uprightly from said left and right sides of said base, respectively, a cutter carriage including left and right carriage ends mounted respectively and slidably on said left and right pair of posts, each of said left and right carriage ends being formed with a vertical through hole, said cutter carriage defining a horizontal line extending from said left carriage end to said right carriage end;

left and right screw rods, each of which defines an axis, extends through a respective one of said through holes in said left and right carriage ends, and is rotatable about said axis, each of said left and right screw rods having a plurality of threads, an adjacent pair of said threads defining a pitch therebetweem;

a transmission unit connected to said left and right screw rods to permit synchronous rotation of said left and right screw rods;

left and right thread members respectively provided on said left and right carriage ends and threadedly engaging said left and right screw rods respectively, so as to permit vertical movement of said cutter carriage relative to said base along said posts upon rotation of said left and right screw rods, said left thread member being formed with an engaging hole extending in a transverse direction relative to said axis; and a fine adjusting unit including a mounting wall mounted on said left carriage end adjacent to said left thread member, and a rod member extending in said transverse direction and having a first rod section rotatably mounted on said mounting wall and a second rod section extending eccentrically from said first rod section and received fittingly in said engaging hole in said left thread member, said fine adjusting unit being operable in case said horizontal line is not parallel to said base after adjustment of said cutter carriage to a desired level via rotation of said left and right screw rods such that rotation of said first rod section on said mounting wall results in vertical movement of said left thread member relative to said left screw rod by a distance within said pitch, thereby permitting said horizontal line X to be parallel to said base.

2. The wood planing machine as defined in claim 1, wherein said right carriage end is further formed with a threaded hole adjacent to the respective one of said through holes, and includes a headed pressing screw threadedly engaging said threaded hole and having a head portion, said right thread member including a tubular portion fittingly inserted in the respective one of said through holes and having inner threads engaging said right screw rod, and a ending flange that extends radially and outwardly from a top end of said tubular portion, that is ended on said right carriage end, and that is formed with a plurality of angularly spaced apart shoulders, said head portion of said headed pressing screw selectively engaging and pressing one of said shoulders so as to prevent disengagement and wobbling of said right thread member relative to said right screw rod.

* * * * *